US007680558B2

(12) United States Patent
Yamada

(10) Patent No.: US 7,680,558 B2
(45) Date of Patent: Mar. 16, 2010

(54) EMBROIDERY DATA CREATION APPARATUS AND EMBROIDERY DATA CREATION PROGRAM RECORDED IN COMPUTER-READABLE RECORDING MEDIUM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 735 days.

(21) Appl. No.: 11/637,716

(22) Filed: Dec. 13, 2006

(65) Prior Publication Data

US 2007/0162177 A1 Jul. 12, 2007

(30) Foreign Application Priority Data

Dec. 27, 2005 (JP) ..... 2005-373742

(51) Int. Cl.
*D05C 5/02* (2006.01)

(52) U.S. Cl. ..... 700/138; 112/470.01; 112/475.19

(58) Field of Classification Search ..... 700/136–138; 112/102.5, 470.01, 470.04, 470.06, 475.18, 112/475.19

See application file for complete search history.

(56) References Cited

U.S. PATENT DOCUMENTS

| | | | | |
|---|---|---|---|---|
| 4,982,674 | A * | 1/1991 | Hayakawa | 112/102.5 |
| 5,934,209 | A * | 8/1999 | Mizuno | 112/102.5 |
| 6,010,238 | A * | 1/2000 | Kotaki | 700/138 |
| 6,356,648 | B1 * | 3/2002 | Taguchi | 112/470.06 |
| 6,629,015 | B2 | 9/2003 | Yamada | |
| 6,836,695 | B1 * | 12/2004 | Goldman | 700/138 |
| 6,934,599 | B2 * | 8/2005 | Kaymer et al. | 700/138 |
| 2004/0243275 | A1 * | 12/2004 | Goldman | 700/138 |

FOREIGN PATENT DOCUMENTS

JP A 2001-259268 9/2001

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

The process searches a block that contains a current line segment for any other line segments and, if they are found, calculates a distance between an endpoint of the current line segment and endpoint nodes of all the line segments found in the block. The process sequentially searches for the line segments in the block in accordance with search order determined on the basis of a search ranking table if a search range is not crossed over and calculates the distances between the endpoint of the current line segment and the endpoint nodes of the found line segments. Then, the process compares the distance from the endpoint node of the already line segment found and the distance from the newly found endpoint node and outputs the smaller one as the next line segment.

24 Claims, 11 Drawing Sheets

EMBROIDERY DATA CREATION APPARATUS AND EMBROIDERY DATA CREATION PROGRAM RECORDED IN COMPUTER-READABLE RECORDING MEDIUM

INCORPORATION BY REFERENCE

The disclosure of Japanese Patent Application No. 2005-373742 filed on Dec. 27, 2005 including the specification, drawings and abstract is incorporated herein by reference in its entirety.

BACKGROUND

The disclosure relates to an embroidery data creation apparatus and an embroidery data creation program.

Conventionally, it has been difficult automatically creating embroidery data from a photographic image etc., whose color density and color continuously change two-dimensionally. To solve this problem, the present Applicant proposed an embroidery data creation method, disclosed in Japanese Patent Application Laid Open Publication No. 2001-259268.

According to a procedure of this method, information of a line segment having an angle is first created from an input image based on image data such as a photographic image. Next, thread color information is set to each of the line segments in accordance with color information of the input image. Subsequently, the line segments are connected to each other for each of the thread colors, and embroidery data is created.

SUMMARY

In this procedure, if these line segments are not interconnected carefully, a lot of useless jump stitches will occur. Therefore, to avoid the occurrence of useless jump stitches, by this conventional embroidery data creation method, distances between endpoints of the line segments are calculated in the round robin manner so that the line segments whose endpoints are the nearest to each other may be interconnected one by one.

However, one batch of image data involves the generation of several thousands to several tens of thousands of line segments, which leads to the problem of a prolonged processing time required to calculate the distances in the round robin manner.

To solve these problems, the disclosure has been developed, and it is an object of the disclosure, to provide an embroidery data creation apparatus and an embroidery data creation program that can reduce the calculation time involved in interconnecting of line segments.

To achieve the object described above, according to a first aspect of the present disclosure, an embroidery data creation apparatus includes a line segment data creation device that creates, from an image, a plurality of line segment data pieces having an arbitrary angle component; an embroidery data creation device that creates embroidery data by connecting endpoint nodes of line segments to each other in such a manner that stitches are formed sequentially along a plurality of line segments specified by the plurality of line segment data pieces created by the line segment data creation device; a search device that preferentially searches a vicinity of a specific line segment when searching for such a line segment that is to be connected next to the specific line segment; an inter-endpoint node distance calculation device that calculates a distance between an endpoint node of the line segment found as a result of a search by the search device and an endpoint node of the specific line segment; a search range setting device that sets a search range to be searched by the search device; a selection device that selects the line segments that are closer to the specific line segment based on a result of calculations by the inter-endpoint node distance calculation device; a search termination device that terminates the search by the search device when all of the line segments in the search range set by the search range setting device have been searched for; and a connection device that sequentially connects the line segments selected by the selection device to each other.

According to a second aspect of the present disclosure, a controller of the embroidery data creation apparatus creates, from an image, a plurality of line segment data pieces having an arbitrary angle component; creates embroidery data by connecting endpoint nodes of line segments to each other in such a manner that stitches are formed sequentially along a plurality of line segments specified by the created plurality of line segment data pieces; preferentially searches a vicinity of a specific line segment when searching for such a line segment that is to be connected next to the specific line segment; calculates a distance between an endpoint node of the line segment found as a result of a search and an endpoint node of the specific line segment; sets a search range in which the line segment that is to be connected next to the specific line segment is searched for; selects the line segments that are closer to the specific line segment based on a result of a calculation of the distance between the endpoint node of the line segment found as a result of the search and the endpoint node of the specific line segment; terminates the search when all of the line segments in the set search range have been searched for; and sequentially connects the selected line segments to each other.

According to a third aspect of the present disclosure, a storage medium storing a set of program instructions executable on a data processing device and usable for creating embroidery data, the set of program instructions includes a line segment data creation step of creating, from an image, a plurality of line segment data pieces having an arbitrary angle component; an embroidery data creation step of creating embroidery data by connecting endpoint nodes of line segments to each other in such a manner that stitches are formed sequentially along a plurality of line segments specified by the plurality of line segment data pieces created by the line segment data creation step; a search step of preferentially searching a vicinity of a specific line segment when searching for such a line segment that is to be connected next to the specific line segment; an inter-endpoint node distance calculation step of calculating a distance between an endpoint node of the line segment found as a result of a search by the search step and an endpoint node of the specific line segment; a search range setting step of setting a search range to be searched by the search step; a selection step of selecting the line segments that are closer to the specific line segment based on a result of calculations by the inter-endpoint node distance calculation step; a search termination step of terminating the search by the search step when all of the line segments in the search range set by the search range setting step have been searched for; and a connection step of sequentially connecting the line segments selected by the selection step to each other.

BRIEF DESCRIPTION OF THE DRAWINGS

Exemplary embodiments of the disclosure will be described below in detail with reference to the accompanying drawings in which.

DETAILED DESCRIPTION OF EMBODIMENTS

Figure 11:
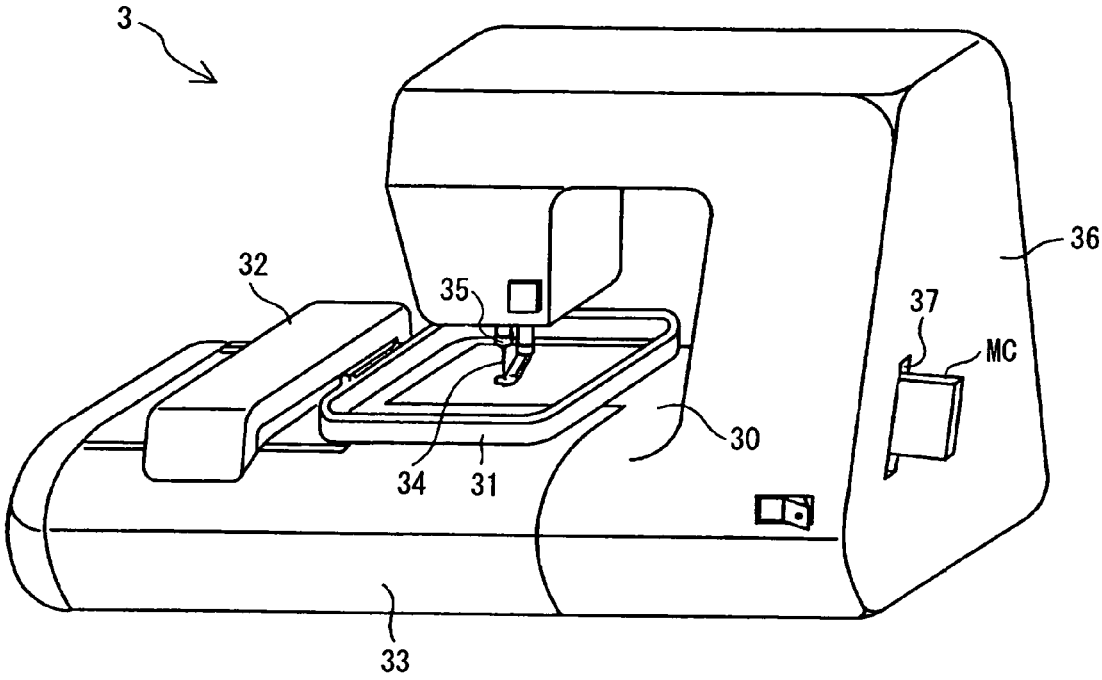
FIG. 11 is an external view of an embroidering machine.

The following will describe an embroidery data creation apparatus related to the disclosure with reference to drawings. First, an embroidery data creation apparatus of the disclosure is used to create and edit embroidery data which is supplied to an embroidering machine 3 shown in FIG. 11. As shown in FIG. 11, the embroidering machine 3 is configured to embroider a predetermined design on a work cloth to be embroidered while moving an embroidery frame 31 holding this work cloth to a predetermined position indicated by an X-Y coordinate system peculiar to the apparatus. It should be noted this processed cloth is arranged on a machine bed 30. The embroidery frame 31 is moved by a Y-directional drive section 32 and an X-directional drive mechanism contained in a body case 33. Embroidering is performed by involving a sewing needle 34 and a shuttle mechanism, not shown, into sewing operations. The Y-directional drive section 32, X-directional drive mechanism, a needle bar 35, etc. are controlled by a controller comprising a microcomputer etc. incorporated in the embroidering machine 3.

Further, on a side surface of a pillar 36 of the embroidering machine 3, a memory card slot 37 is formed. When a memory card MC in which embroidery data is stored is inserted into the memory card slot 37, the embroidery data is thereby supplied from the outside. The embroidery data contains information indicating color codes, embroidering positions and sizes, and stitch data indicating stitches used in expression by use of embroidery. Based on this embroidery data, the controller in the embroidering machine automatically embroiders a design.

Next, a configuration of the embroidery data creation apparatus is described with reference to the drawings.

Figure 1:
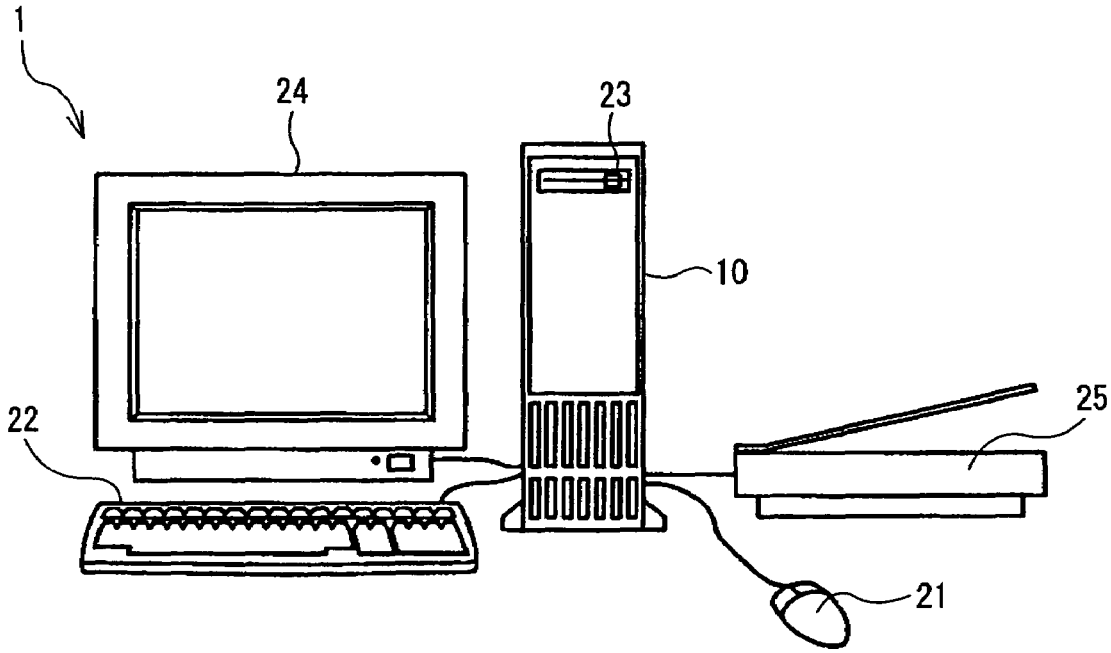
FIG. 1 is an overall configuration illustration showing a physical configuration of an embroidery data creation apparatus.

As shown in FIG. 1, this embroidery data creation apparatus 1 is used to create and edit embroidery data which is supplied to the sewing machine as described above. Basically, the embroidery data creation apparatus 1 comprises an apparatus body 10, and a mouse 21, a keyboard 22, a memory card connector 23, a display apparatus 24, and an image scanner apparatus 25 that are connected to this apparatus body 10.

Figure 2:
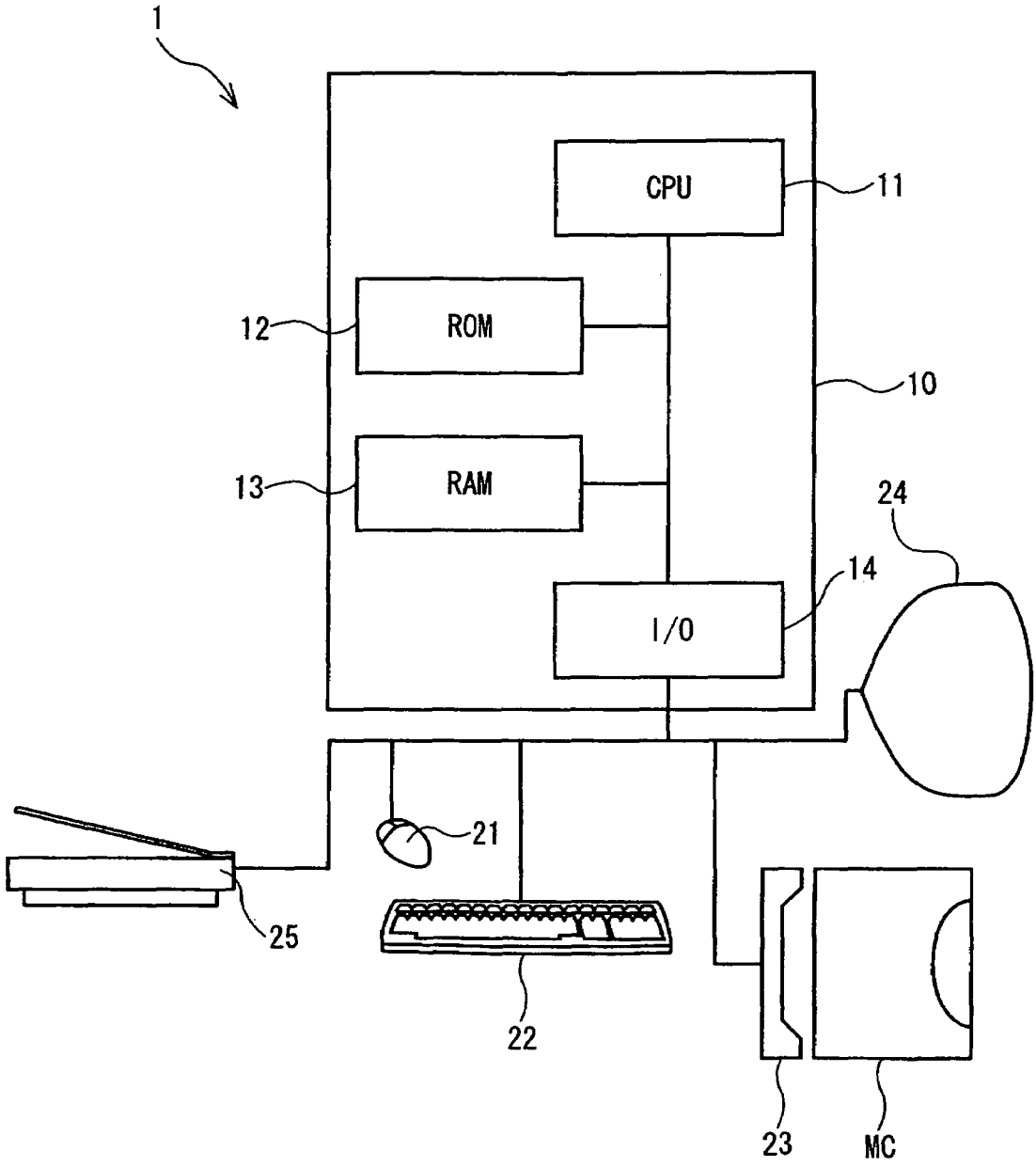
FIG. 2 is a block diagram showing the functional configuration of the embroidery data creation apparatus.

Further, as shown in FIG. 2, the apparatus body 10 is equipped with a CPU 11, a ROM 12, a RAM 13, and an I/O interface 14 in such a configuration that the mouse 21, the keyboard 22, the memory card connector 23, the display apparatus 24, and the image scanner apparatus 25 are connected to the I/O interface 14. The MC (memory card) can be connected to the memory card connector 23.

The CPU 11 performs a variety of kinds of operations and processing in accordance with an embroidery data creation program related to the disclosure stored in the ROM 12, which is a read-only memory device. It should be noted that in the case of a computer dedicated to operations, the program is stored in the ROM, whereas in the case of a general-purpose computer (personal computer etc.), the program stored in a hard disk etc. is read into the RAM before it is executed.

The RAM 13, which is a random access memory, can store image data read from the image scanner apparatus 25 or an external memory apparatus, such as a hard disk (not shown), a CD-ROM, or a CD-R.

Next, a procedure to create embroidery data based on a photographic image by using the embroidery data creation apparatus 1 configured as described above is now described below with reference to FIGS. 3-10.

Figure 3:
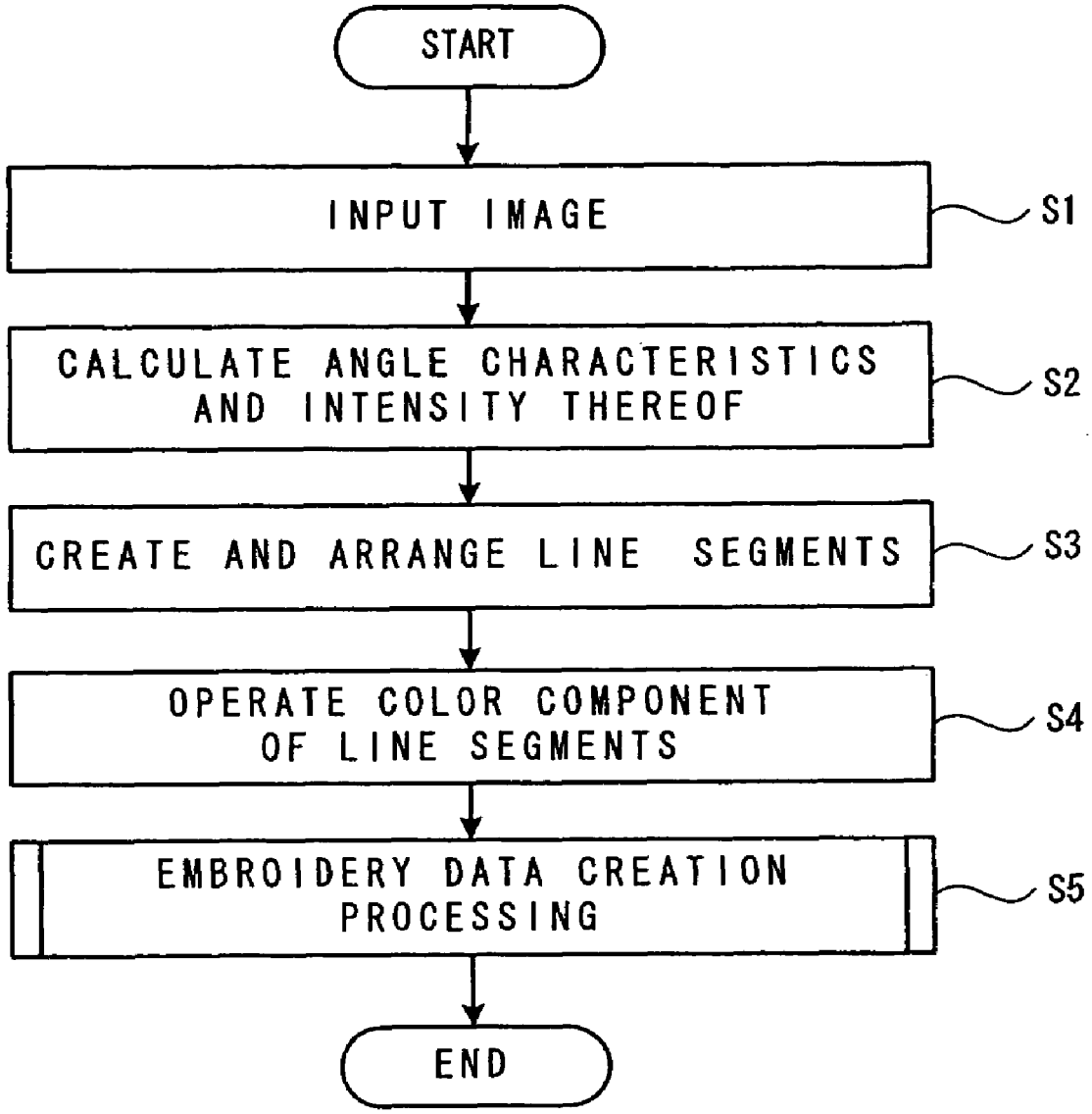
FIG. 3 is a flowchart illustrating the main processing used to create the embroidery data.
Figure 4:
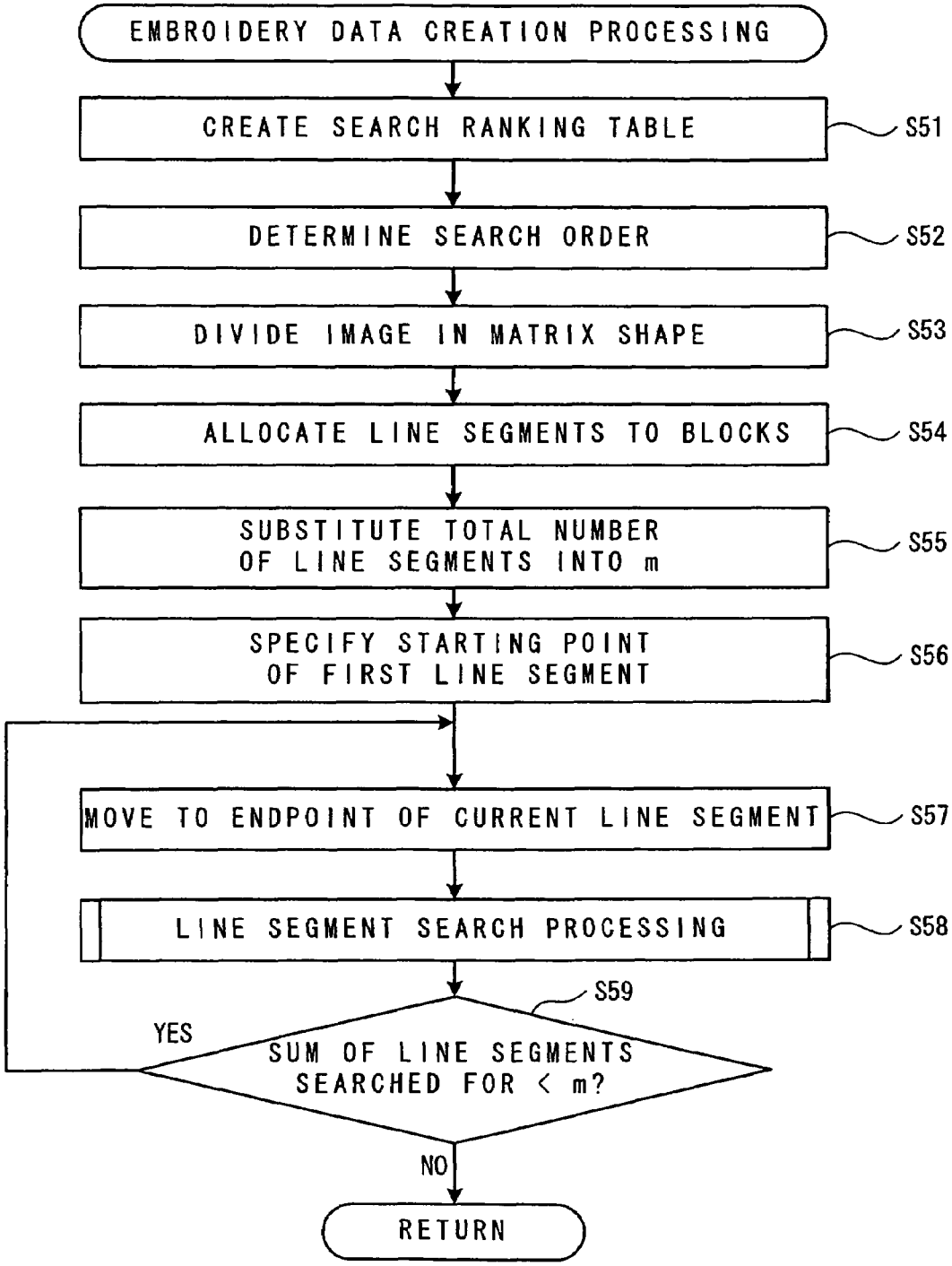
FIG. 4 is a flowchart of embroidery data creation processing that is performed in the main processing.

As shown in FIG. 3, when the main processing is started, first, image data acquired by reading the photographic image by means of the image scanner apparatus 25 is input to the apparatus body 10 (S1). It should be noted that, as described above, the image data read from an external memory apparatus, such as a hard disk, a CD-ROM, or a CD-R can also be input directly into the apparatus body 10.

Next, the process uses a known process to calculate angle characteristics and an intensity of the angle characteristics for each of the pixel data pieces constituting the input image data (S2). Next, based on the angle characteristics and the intensity of the angle characteristics at each of the pixels obtained at S2, line segment data pieces are created and allocated (S3). A line segment specified by this line segment data eventually provides a stitch of embroidery data.

At S3, first the process creates the line segment data having an angle component and a length component, which are combined with a color component to thereby make up the eventually-created line segment data. As the angle component, the angle characteristics calculated for each of the pixels at S2 are set as they are. As the length component, a preset fixed value or a value entered by an operator is set. Specifically, such line segment data is created so that line segments having thus set angle components and length component may be arranged around a target pixel.

In this case, line segment data is created for each of the pixels that make up an image, so that if an embroidery is sewn in accordance with embroidery data created on the basis of this line segment data, the number of needles becomes extremely large or the same place is sewn repeatedly, thus damaging the sewing quality. Further, line segment data is created in the same way for a pixel that has a small intensity of the angle characteristics, which leads to a fear that characteristics of the image as a whole may not effectively be reflected in the created embroidery data.

To solve this problem, the pixels of the image are sequentially scanned from left to right and from top to bottom, to calculate an intensity of angle characteristics, based on which intensity the line segment data pieces are created and allocated.

Next, the color component of each of the line segment data pieces is determined (S4). First, after the number of colors of embroidery threads used is input, by inputting thread color information and color codes of the embroidery threads used for each of this input number of colors, a thread-versus-color correlation table is created. Further, in this case also, the order in which the color threads are sewn is set simultaneously. This order of sewing the color threads may be preset or entered by the operator on an entry screen. Subsequently, the process determines the color component of each of the created line segment data pieces.

Next, the process creates embroidery data based on a group of the line segment data pieces having the angle component, the length component, and the color component that are created for each of the plurality of pixels that constitute the image as described above (S5), and ends the main processing. Details of the embroidery data creation processing are described later with reference to FIGS. 4-7.

Next, the embroidery data creation processing is described with reference to FIGS. 4-7. Embroidery data is created on the basis of a group of line segment data pieces basically by converting, for each of identical color components, a starting point, an endpoint, and color component that are specified by each of the line segment data pieces into a starting point, an endpoint, and a color of a stitch. However, if line segments are all converted into independent stitches, jump-stitch places occur as many as the number of the line segments. Moreover, each of the jump-stitch places may need a reinforcement stitch, thus damaging the sewing quality. Therefore, to convert these line segments into a continuous stitch as much as possible, the following processing is performed.

Figure 5:
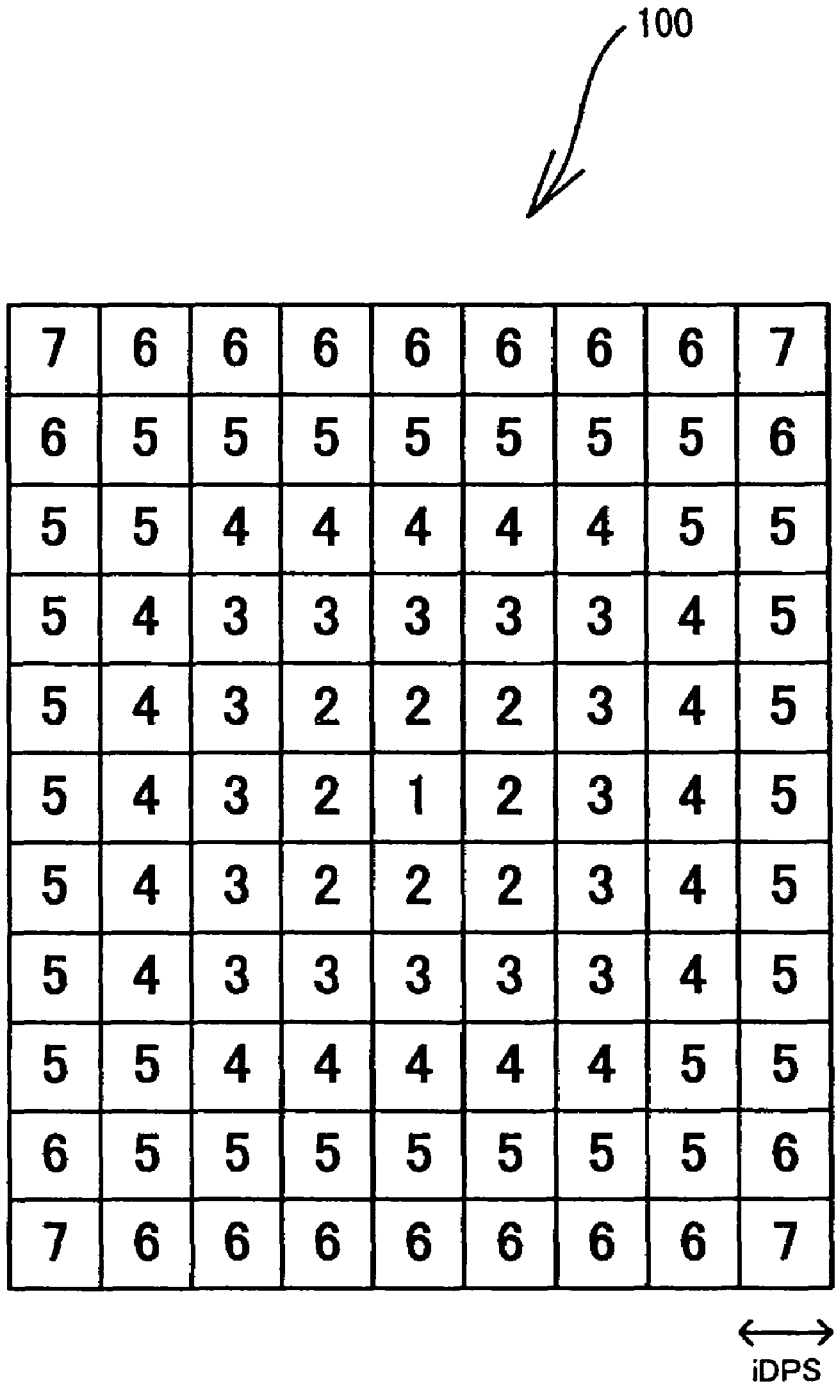
FIG. 5 is an explanatory diagram of a search ranking table which is created in the embroidery data creation processing.

First, to determine the order of line segment data to be searched, the process creates a search ranking table 100 such as shown in FIG. 5 (S51). This search ranking table 100 comprises square blocks whose sides are as long as the length of a preset line segment (iDPS), and each side represents its own search ranking with respect to a current block at the center. The search ranking is set based on a distance of the block measured from the current block; that is, if the distance of a block therefrom is smaller than 1*iDPS, the block is assigned ranking 1, if the distance of the block therefrom is smaller than 2*iDPS, it is assigned ranking 2, if the distance of the block therefrom is smaller than 3*iDPS, it is assigned ranking 3, if the distance of the block therefrom is smaller than 4*iDPS, it is assigned ranking 4, if the distance of the block therefrom is smaller than 5*iDPS, it is assigned ranking 5, . . . , and if the distance of the block therefrom is smaller than n*iDPS, it is assigned ranking n.

Next, in accordance with the rankings given in the created search ranking table 100, the blocks are sorted to determine the order in which they are to be searched (S52). By this search order determination processing, priorities among the block having a same ranking are also determined, and the order in which these blocks are searched is clarified. For example, such inter-block searching order is determined as indicated by an arrow in FIG. 6.

Next, a target image is divided into the shape of a matrix to create square blocks (S53). In the present embodiment, it is divided into blocks 210 each of which has a side length equal to the line segment length (iDPS) (see FIG. 7). It should be noted that the processing to divide the image into the shape of a matrix may be performed prior to the search ranking table creation processing of S51. As should be appreciated, the square blocks include any four sided blocks, including rectangular blocks, and can be any number sided block (i.e., 3, 5, 6 . . . sided blocks). For example, the target image can be divided into the shape of a matrix to create a rectangular block.

Figure 7:
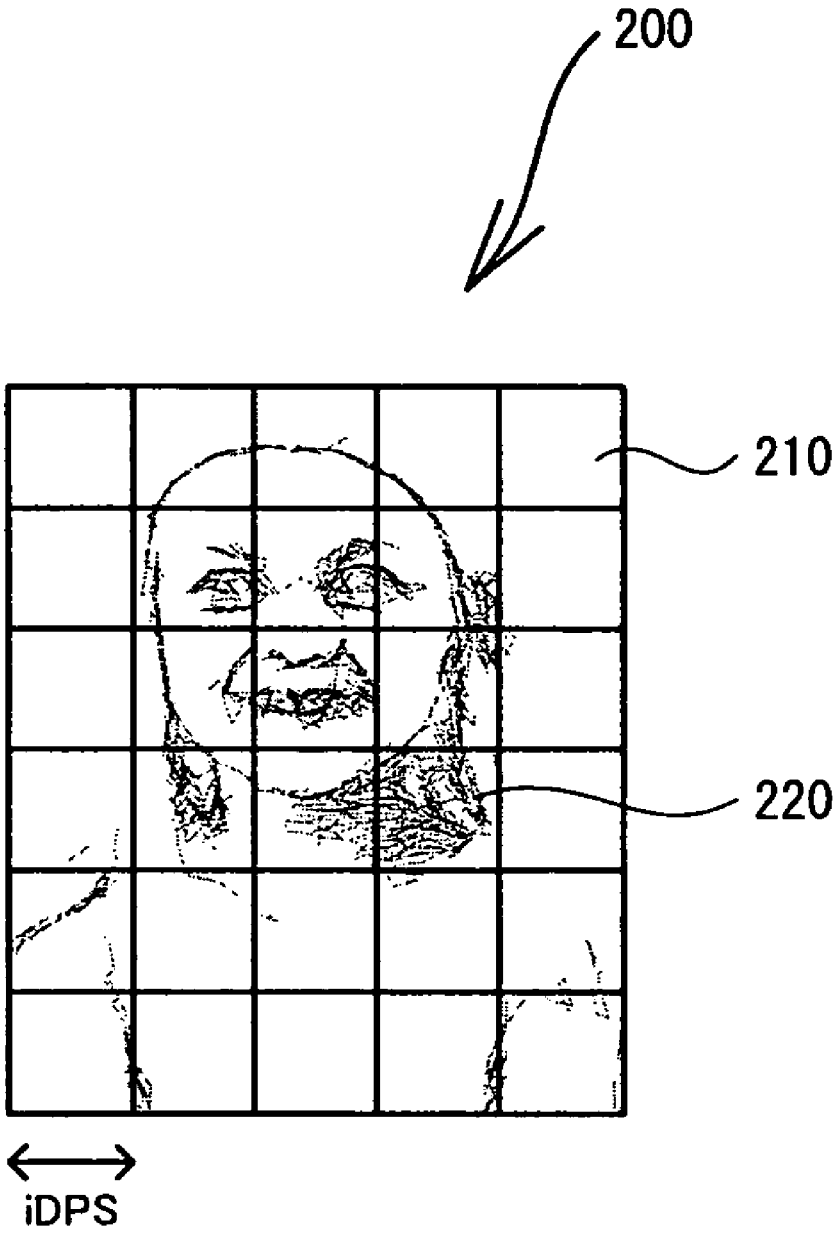
FIG. 7 is an explanatory diagram showing a state in which a line segment arrangement region is divided into blocks.

Next, line segment data 220 is allocated to the created blocks (S54). For example, a line segment arrangement region 200 in which the line segment data 220 created from the image is allocated is covered by the divided blocks in the shape of the matrix, to give such a layout as shown in FIG. 7. Then, a total number of the line segments is substituted into m (S55).

Next, to determine the order in which the line segments are to be connected to each other, the first line segment to provide a base point is determined, to specify a starting point of this first line segment (S56). It should be noted that there is no superiority in determining the first line segment, so that an arbitrary one of the line segments can be specified as the first line segment.

Next, the process moves a target point to an endpoint of a current line segment (the first line segment in this first processing) (S57). In accordance with the order determined at S52, the process performs line segment search processing to search for the line segments for each of the blocks (S58). Details of the line segment search processing are described later with reference to FIGS. 8-10.

The process then determines whether a sum of the line segments searched for so far has reached the total number of line segments m (S59), and as far as the sum is smaller than the total number m (YES at S59), the process returns to step S57 to repeat the processing. If the sum of the line segment searched for so far has reached the total number (NO at S59), it means that the connection order of all of the line segments has been determined, they have been connected, and embroidery data have been created, so that the process returns to the main processing.

Figure 8:
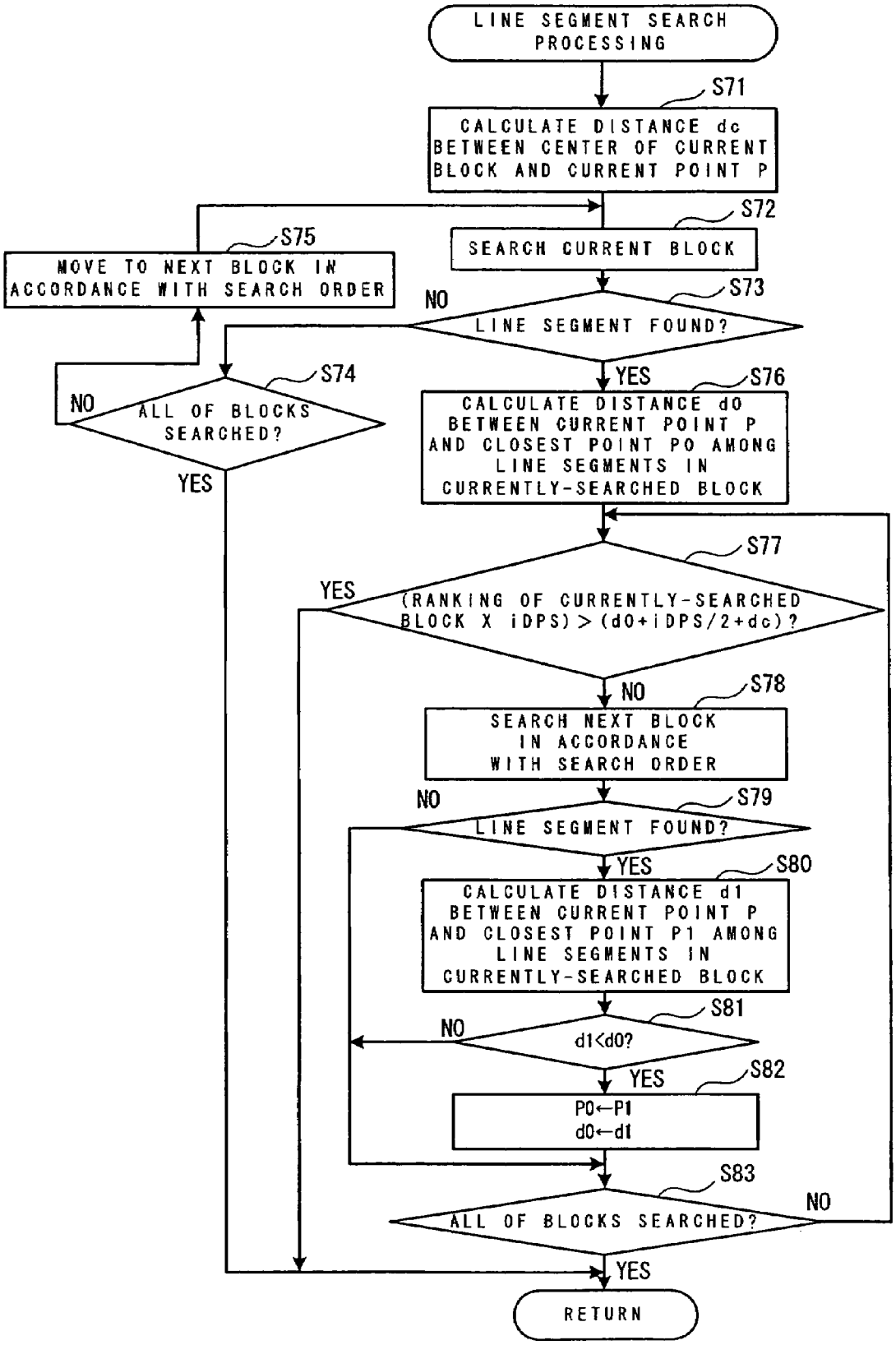
FIG. 8 is a flowchart of line segment search processing which is performed in the embroidery data creation processing.

Next, the line segment search processing which is performed in the embroidery data creation processing is described with reference to FIGS. 8-10. As shown in FIG. 8, first the process calculates a distance dc of a current point P from a center of a current block 211 (S71).

Figure 9:
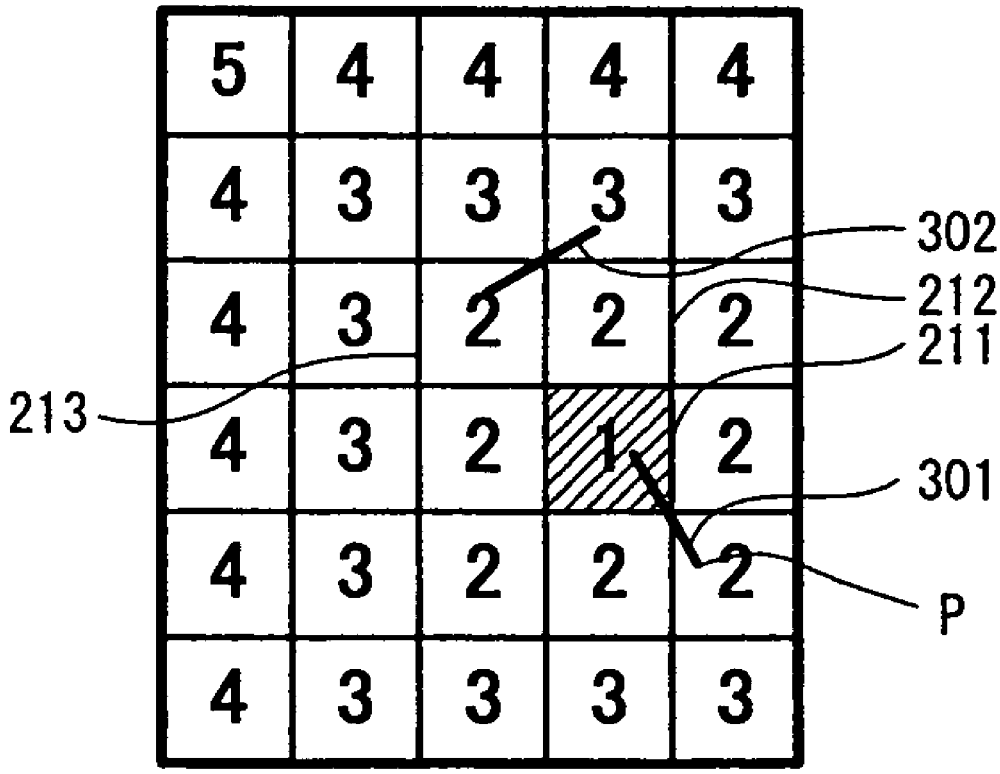
FIG. 9 is an explanatory diagram of searching for line segments in the line segment search processing.
Figure 10:
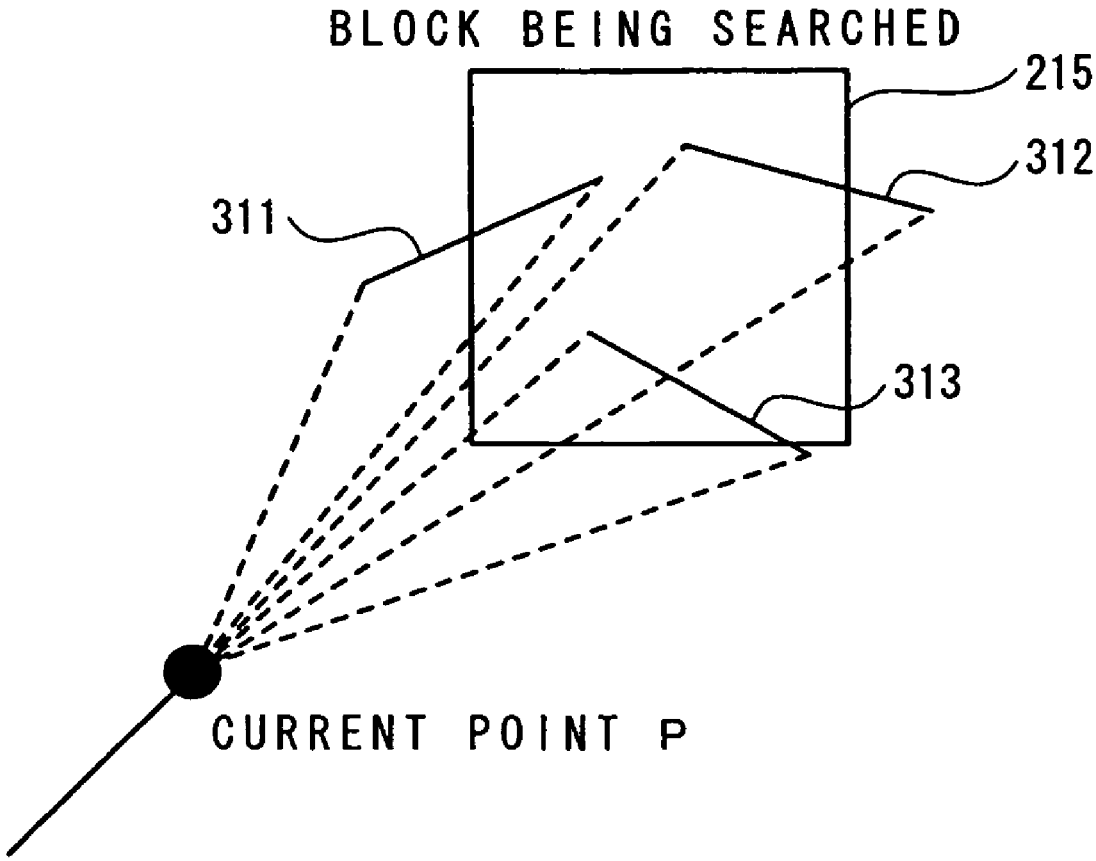
FIG. 10 is an explanatory diagram of calculating an inter-endpoint node distance when the line segments are found.

It should be noted that as shown in FIG. 9 the current block 211 refers to a block to which a current target line segment 301 belongs. Which one of the blocks a line segment belongs to is determined by a midpoint of this line segment beforehand in the present embodiment. If it refers to a block to which an endpoint node belongs, it may take a long calculation time to determine the connection order, so that the midpoint is employed in order to determine which block the line segment belongs. Further, the current point P refers to an endpoint of the current line segment 301 that has moved at S57 of FIG. 4 and provides a base point for calculating the distance to the next line segment. It should be noted that the distance dc calculated at S71 is used to set a search range later.

Next, the process searches the current block 211 for line segments (S72). Then, the process determines whether any line segments have been found as a result of the search (S73). If no line segments have been found (NO at S73), the process determines whether all of the blocks have been searched for line segments (S74), and if the line segment search processing for line segments has been completed on all of the blocks (YES at S74), the process returns to the embroidery data creation processing.

If not all of the blocks have undergone the line segment search processing (NO at S74), the process moves to the next block to undergo the line segment search processing, in accordance with the search order determined in the embroidery data creation processing (S75). Then, the process returns to S72. For example, in FIG. 9, if the line segment search of the block 211 has resulted in no line segments being found, the process moves to the next block 212 for another line segment 302 in accordance with the search order shown in FIG. 6.

Figure 6:
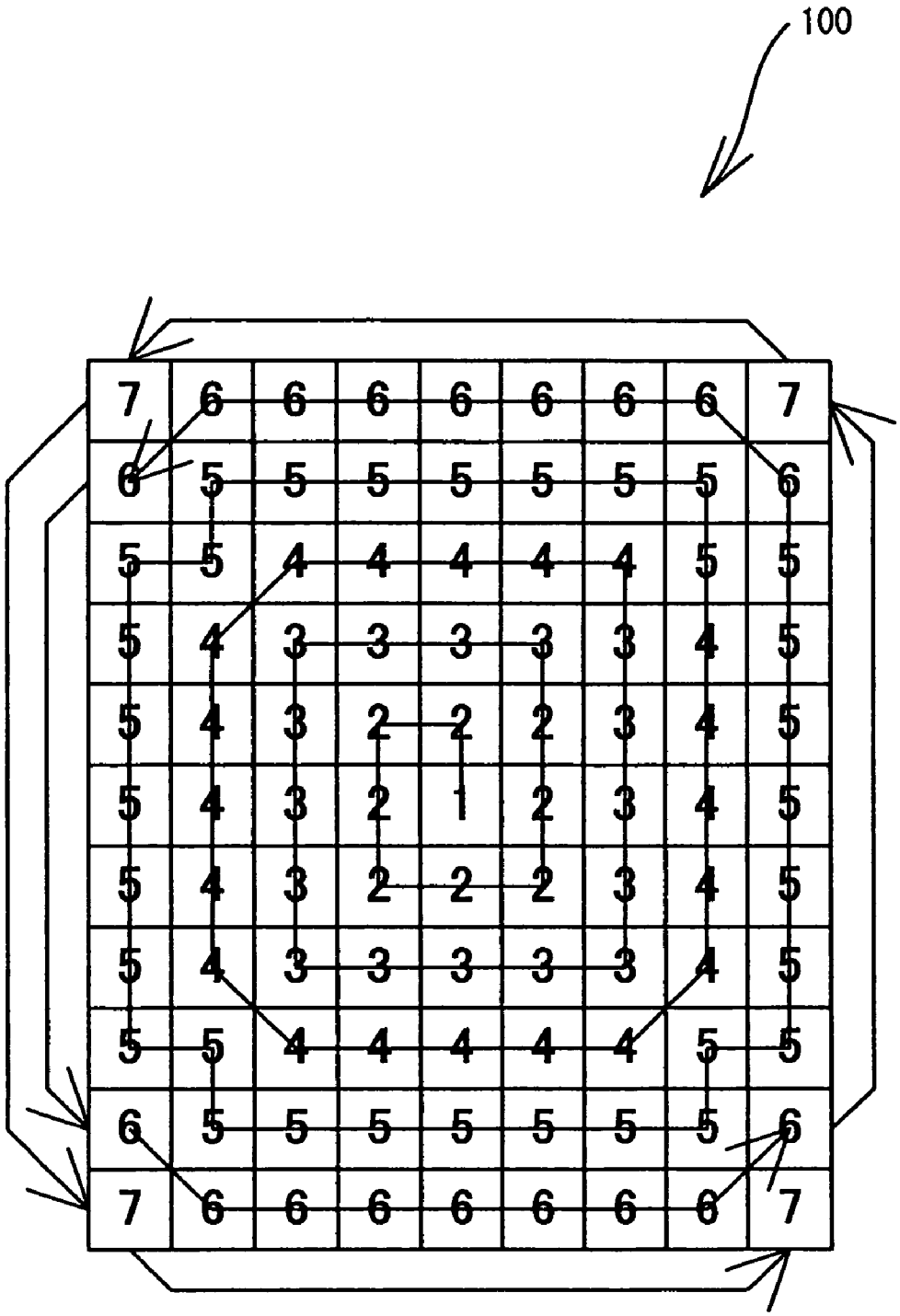
FIG. 6 is an explanatory diagram of the search ranking table in which search order is determined.

Further, if line segment search of the block 212 has resulted in no line segments being found, the process moves to the next block 213 to undergo the line segment search processing in accordance with the search order shown in FIG. 6.

If any line segments have been found in the bock currently being searched (YES at S73), the process calculates a distance d0 between the current point P and a point P0 of one such of the line segments in this block that is closest to the current point P (S76). For example, as shown in FIG. 10, if a plurality of line segments 311, 312, and 313 are found in a block 215 being searched currently, the process calculates distances between endpoint nodes of these line segments respectively and the current point P and sets the smallest one of these distances as d0.

Next, the process determines whether a search range has been crossed over (S77). In the present embodiment, a search range is set by using the distance dc calculated at S71 between the point P and the center of a starting block (block 211 in the FIG. 9) and the distance d0 obtained at S76 between the point P and the endpoint node of one such of the line segments found in a current search blocks to be closet to the point P. That is, the process determines whether a value obtained by multiplying a value of a search ranking of the currently-searched block by the length iDPS is larger than a sum of d0, dc, and a half of iDPS.

It should be noted that the search range may be set not only by the method of the present embodiment that uses calculation results obtained by the inter-endpoint node distance calculation step but also by, for example, a method for determining a line segment, if found at S73, to be connected next and for terminating the line segment search processing to return to the embroidery data creation processing. Further, such a method may be employed as to set a range within a predetermined distance from the point P0 calculated at S76 as a search range and decide at S77 whether an endpoint node of a line segment found has gone out of this predetermined distance.

If the search range has been crossed over (YES at S77), the process outputs the most recently obtained point P0 (that is, a point determined to be closest to the current point P at S76) as a starting point of a line segment, and returns to the embroidery data creation processing.

If the search range is not crossed over (NO at S77), any other blocks may have a line segment closer than the currently found one, so that the process searches the next block for any line segments in accordance with the search order (S78). Then, the process determines whether line segments have been found as a result of the search (S79). If no line segments have been found (NO at S79), the process determines whether all of the blocks have been searched for line segments (S83). If the line segment search processing has been completed on all of the blocks (YES at S83), the process returns to the embroidery data creation processing. If not all of the blocks have undergone the line segment search processing (NO at S83), the process returns to S77 to repeat the processing.

If line segments have been found in the currently-searched block at S79 (YES at S79), the process calculates a distance d1 between the current point P and the point P1 that is closest to the point P among the line segments in that block (S80). Then, the process compares d1 and d0 obtained at S76 and determines whether d1 is smaller than d0, that is, whether an endpoint node of the line segment found most recently is closer to the current point P (S81).

If d1 is smaller than d0 (YES at S81), the process sets P1 as P0 and d1 as d0 in order to set the most recently found line segments as a candidate of the closest line segment (S82). Then, the process determines whether all of the blocks have been searched for line segments (S83). If the line segment search processing has been completed on all of the blocks (YES at S83), the process returns to the embroidery data creation processing. If not all of the blocks have undergone the line segment search processing (NO at S83), the process returns to S77 to repeat the processing.

If d1 is not smaller than d0 (NO at S81), the process determines whether all of the blocks have been searched for line segments (S83). If the line segment search processing has been completed on all of the blocks (YES at S83), the process returns to the embroidery data creation processing. If not all of the blocks have undergone the line segment search processing (NO at S83), the process returns to S77 to repeat the processing.

By the above-described line segment search processing, a line segment closest to the current point P in a search range is found and set as P0 and then output. By creating embroidery data by thus setting a search range by using the distance d0 between the current point P and the point P0 of a line segment found and repeating the line segment search processing to sequentially connect line segments to each other, it is possible to avoid wasteful operations in contrast to the case of the round robin method, thereby enhancing a processing speed.

As described above, when connecting endpoint nodes of line segments to each other in order to create embroidery data, an embroidery data creation apparatus of the present disclosure preferentially searches a vicinity of a specific line segment in a preset search range to select the closer line segments and interconnect them sequentially and, therefore, can reduce the processing time as compared with the case of calculating the distances for all of the line segments in the round robin manner and connecting them to each other.

Further, the embroidery data creation apparatus of the present disclosure sets a range acquired to a moment when a line segment is found first as a search range, and can thus determine line segment searching order in an even shorter time.

Further, the embroidery data creation apparatus of the present disclosure sets a range within a predetermined distance from a first line segment found as a search range, and can thus determine the line segment searching order in an even shorter time.

Further, the embroidery data creation apparatus and program of the present disclosure calculates a distance between endpoint nodes of a line segment found and sets a search range based on a result of this calculation, and can thus determine a more appropriate line segment connecting order.

Further, the embroidery data creation apparatus and program of the present disclosure divides a range in which line segments are arranged into blocks and presets an order in which these blocks are searched for. Then, the present apparatus searches each of the blocks in accordance with the searching order and sets a range of up to such a block as to have a predetermined search ranking, thereby enabling a reduction of processing time required to search for the line segments.

Further, the embroidery data creation apparatus and program of the present disclosure ranks blocks, in each of which line segments are arranged in such a manner that the closer blocks may be assigned higher search rankings. The search for the closer line segments is thus faster.

Further, the embroidery data creation apparatus and program of the present disclosure assumes that a line segment whose midpoint is present in a block belongs to this block and so has an effect that the closer line segments can be searched for more easily than when it is assumed that a line segment whose either endpoint node is present in a block belongs to this block.

Further, the embroidery data creation apparatus and program of the present disclosure provides square or rectangle blocks into which a region in which line segments are arranged is divided and so can reduce time required to search for the line segments.

Further, an embroidery data creation program of the present disclosure, when connecting endpoint nodes of line segments to each other to create embroidery data, preferentially searches a vicinity of a specific line segment within a search range set by a search range setting step so that the closer line segments may be selected and sequentially connected to each other, thereby enabling reduction of the processing time as compared with the case of calculating distances for all of the line segments in the round robin manner and interconnecting them.

Further, the embroidery data creation program of the present disclosure sets a range in which a line segment is found first as a search range by a search step, and can thus determine line segment searching order in an even shorter time.

Further, the embroidery data creation program of the present disclosure sets a range within a predetermined distance from a line segment found first as a search range by the search step, and can thus determine the line segment searching order in an even shorter time.

In the illustrated embodiments, a controller (CPU 11) preferably is implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the invention.

Although the invention has been described with reference to exemplary embodiments, it is to be understood that the invention is not limited to the exemplary embodiments or structures. Though the various elements of the exemplary embodiments are shown in various combinations and configurations, which are exemplary, other combinations and configurations, including more, less or only a single element, are also within the spirit and scope of the disclosure.

What is claimed is:

1. An embroidery data creation apparatus, comprising:

a line segment data creation device that creates, from an image, a plurality of line segment data pieces having an arbitrary angle component;

an embroidery data creation device that creates embroidery data by connecting endpoint nodes of line segments to each other in such a manner that stitches are formed sequentially along a plurality of line segments specified by the plurality of line segment data pieces created by the line segment data creation device;

a search device that preferentially searches a vicinity of a specific line segment when searching for such a line segment that is to be connected next to the specific line segment;

an inter-endpoint node distance calculation device that calculates a distance between an endpoint node of the line segment found as a result of a search by the search device and an endpoint node of the specific line segment;

a search range setting device that sets a search range to be searched by the search device;

a selection device that selects the line segments that are closer to the specific line segment based on a result of calculations by the inter-endpoint node distance calculation device;

a search termination device that terminates the search by the search device when all of the line segments in the search range set by the search range setting device have been searched for; and a connection device that sequentially connects the line segments selected by the selection device to each other.

2. The embroidery data creation apparatus according to claim 1, wherein the search range setting device sets as the search range a range acquired from a moment when the search is started by the search device to a moment when the line segment is first found by the search device.

3. The embroidery data creation apparatus according to claim 1, wherein the search range setting device sets as the search range a range within a predetermined distance from the line segment first found by the search device.

4. The embroidery data creation apparatus according to claim 1, wherein the search range setting device sets the search range based on a result of calculations by the inter-endpoint node distance calculation device.

5. The embroidery data creation apparatus according to claim 1, further comprising:

a line segment arranging region dividing device that divides a region in which the line segment data is allocated into two or more blocks;

a classification device that classifies the line segment data pieces to the blocks into which the region is divided by the line segment arranging region dividing device;

a search ranking table creation device that creates a search ranking table in which search rankings of the blocks with respect to a specific one of the blocks are set; and a search order determination device that determines a search order of the blocks in accordance with the rankings set in the search ranking table created by the search ranking table creation device, wherein:

the search device preferentially searches for the line segments classified into the blocks having higher search rankings, in accordance with the search order determined by the search order determination device; and the search range setting device sets a range up to the block belonging to a predetermined search ranking which is set beforehand as the search range.

6. The embroidery data creation apparatus according to claim 5, wherein the search ranking table creation device ranks the blocks in such a manner that the blocks closer to the specific block are assigned the higher search rankings.

7. The embroidery data creation apparatus according to claim 5, wherein the classification device classifies the line segment, if a midpoint is present in the block, into the block.

8. The embroidery data creation apparatus according to claim 5, wherein the line segment arranging region dividing device divides the region in which the line segment data pieces are allocated into square or rectangle blocks.

9. An embroidery data creation apparatus, comprising a controller that:

creates, from an image, a plurality of line segment data pieces having an arbitrary angle component;

creates embroidery data by connecting endpoint nodes of line segments to each other in such a manner that stitches are formed sequentially along a plurality of line segments specified by the created plurality of line segment data pieces;

preferentially searches a vicinity of a specific line segment when searching for such a line segment that is to be connected next to the specific line segment;

calculates a distance between an endpoint node of the line segment found as a result of a search and an endpoint node of the specific line segment;

sets a search range in which the line segment that is to be connected next to the specific line segment is searched for;

selects the line segments that are closer to the specific line segment based on a result of a calculation of the distance between the endpoint node of the line segment found as a result of the search and the endpoint node of the specific line segment;

terminates the search when all of the line segments in the set search range have been searched for; and sequentially connects the selected line segments to each other.

10. The embroidery data creation apparatus according to claim 9, wherein the controller sets as the search range a range acquired from a moment when the search is started for the line segments to be connected next to the specific line segment to a moment when the line segment is first found.

11. The embroidery data creation apparatus according to claim 9, wherein the controller sets as the search range a range within a predetermined distance from the line segment first found when searching for the line segments to be connected next to the specific line segment.

12. The embroidery data creation apparatus according to claim 9, wherein the controller sets the search range based on a result of calculations of the distance between the endpoint node of the line segment found as a result of search and the endpoint node of the specific line segment.

13. The embroidery data creation apparatus according to claim 9, wherein the controller further:

divides a region in which the line segment data is allocated into two or more blocks;

classifies the line segment data pieces into the divided blocks;

creates a search ranking table in which search rankings of the blocks with respect to a specific one of the blocks are set;

determines a search order of the blocks in accordance with the rankings set in the search ranking table;

preferentially searches for the line segments classified into the blocks having higher search rankings, in accordance with the determined search order; and sets a range up to the block belonging to a predetermined search ranking which is set beforehand as the search range.

14. The embroidery data creation apparatus according to claim 13, wherein the controller ranks the blocks in such a manner that the blocks closer to the specific block are assigned the higher search rankings.

15. The embroidery data creation apparatus according to claim 13, wherein the controller classifies the line segment, if a midpoint is present in the block, into the block.

16. The embroidery data creation apparatus according to claim 13, wherein the controller divides the region in which the line segment data pieces are allocated into square or rectangle blocks.

17. A storage medium storing a set of program instructions executable on a data processing device and usable for creating embroidery data, the set of program instructions comprising:

a line segment data creation step of creating, from an image, a plurality of line segment data pieces having an arbitrary angle component;

an embroidery data creation step of creating embroidery data by connecting endpoint nodes of line segments to each other in such a manner that stitches are formed sequentially along a plurality of line segments specified by the plurality of line segment data pieces created by the line segment data creation step;

a search step of preferentially searching a vicinity of a specific line segment when searching for such a line segment that is to be connected next to the specific line segment;

an inter-endpoint node distance calculation step of calculating a distance between an endpoint node of the line segment found as a result of a search by the search step and an endpoint node of the specific line segment;

a search range setting step of setting a search range to be searched by the search step;

a selection step of selecting the line segments that are closer to the specific line segment based on a result of calculations by the inter-endpoint node distance calculation step;

a search termination step of terminating the search by the search step when all of the line segments in the search range set by the search range setting step have been searched for; and a connection step of sequentially connecting the line segments selected by the selection step to each other.

18. The storage medium according to claim 17, wherein the search range setting step sets as the search range a range acquired from a moment when the search is started by the search step to a moment when the line segment is first found by the search step.

19. The storage medium according to claim 17, wherein the search range setting step sets as the search range a range within a predetermined distance from the line segment first found by the search step.

20. The storage medium according to claim 17, wherein the search range setting step sets the search range based on a result of calculations by the inter-end point node distance calculation step.

21. The storage medium according to claim 17, the embroidery data creation step further comprises:

a line segment arranging region dividing step of dividing a region in which the line segment data is allocated into two or more blocks;

a classification step of classifying the line segment data pieces to the blocks into which the region is divided by the line segment arranging region dividing step;

a search ranking table creation step of creating a search ranking table in which search rankings of the blocks with respect to a specific one of the blocks are set; and a search order determination step of determining a search order of the blocks in accordance with the rankings set in the search ranking table created by the search ranking table creation step; and wherein the search step preferentially searches for the line segments classified into the blocks having higher search rankings, in accordance with the search order determined by the search order determination step; and the search range setting step sets a range up to the block belonging to a predetermined search ranking which is set beforehand as the search range.

22. The storage medium according to claim 21, wherein the search ranking table creation step ranks the blocks in such a manner that the blocks closer to the specific block are assigned the higher search rankings.

23. The storage medium according to claim 21, wherein the classification step classifies the line segment, if a midpoint is present in the block, into the block.

24. The storage medium according to claim 21, wherein the line segment arranging region dividing step divides the region in which the line segment data pieces are allocated into square or rectangle blocks.

* * * * *